United States Patent [19]

Taguchi

[11] 4,411,593

[45] Oct. 25, 1983

[54] ROTARY TYPE PUMP RESISTANT TO MUDDY WATER

[75] Inventor: Michihiro Taguchi, Hamamatsu, Japan

[73] Assignee: Yamaha Hatsudoki Kabushiki Kaisha, Iwata, Japan

[21] Appl. No.: 162,909

[22] Filed: Jun. 25, 1980

[30] Foreign Application Priority Data

Jul. 30, 1979 [JP] Japan ..... 54-96961

[51] Int. Cl.[3] ..... F04D 29/28

[52] U.S. Cl. ..... 415/173 R; 416/174; 418/154; 415/174

[58] Field of Search ..... 415/173 R, 174 R; 416/240, 174; 418/152, 153, 154, 155, 156

[56] References Cited

U.S. PATENT DOCUMENTS

| | | | |
|---|---|---|---|
| 2,466,440 | 4/1949 | Kiekhaefer | 418/154 |
| 2,616,374 | 11/1952 | Carson | 418/154 |
| 2,789,511 | 4/1957 | Doble | 418/154 |
| 2,899,902 | 8/1959 | Bandli et al. | 418/154 |
| 2,902,935 | 9/1959 | Dinnison et al. | 418/154 X |
| 3,001,480 | 9/1961 | Pike | 418/154 |
| 3,183,842 | 5/1965 | Sadler et al. | 418/154 |
| 3,303,791 | 2/1967 | Doble | 418/154 |

*Primary Examiner*—Leonard E. Smith
*Attorney, Agent, or Firm*—Donald D. Mon

[57] ABSTRACT

A rotary type liquid pump of the type used with marine outdoor motors is made resistant to abrasive materials in muddy water which it pumps by providing flexible seals to prevent the water from stealing between the impeller boss and bush, and the drive shaft.

7 Claims, 9 Drawing Figures

ROTARY TYPE PUMP RESISTANT TO MUDDY WATER

FIELD OF THE INVENTION

This invention relates to rotary type liquid pumps of the type frequently used in marine outboard engines.

BACKGROUND OF THE INVENTION

An outboard motor may sometimes be operated in muddy or agitated waters in which fine sand particles or the like are dispersed or mixed. Consequently, the water pump for cooling the engine with such water must be capable of withstanding the adverse effects of these particles. For this purpose, the impeller is frequently made of an elastic material such as rubber. This tends to resist wear that would be caused by interaction with the foreign substances, to prevent the wall of the pump chamber from cracking due to the pressure of the foreign substances. In order to fix the impeller of such elastic material to a drive shaft, a bush having a greater rigidity is customarily buried in the boss of the impeller, and the drive shaft is inserted into the bush, and the bush and the drive shaft are keyed to each other. This jointing construction creates a clearance between the bush and the drive shaft. As a result, there has been the disadvantage that muddy water steals into the clearance so that its foreign substances wear the bush, the drive shaft, the key and the key way. It is an object of this invention to minimize or prevent this disadvantage.

BRIEF DESCRIPTION OF THE INVENTION

In order to overcome the above disadvantage, the impeller of this invention is equipped at both of its axial ends with annular lips that are held in sliding contact with the inner end of the pump chamber, thereby to block the steal of the muddy water into the boss. Due to the aforementioned clearance between the bush and the drive shaft, however, the impeller could be inclined with respect to the drive shaft with the resultant disadvantage that the lips would leave the inner wall of the pump chamber and allow the muddy water to steal to the drive shaft.

The present invention contemplates to provide a rotary type liquid pump which has its impeller made free from inclination with respect to the drive shaft so that the rate at which a foreign substance such as that contained in muddy water steals into the clearance between the drive shaft and the bush can be reduced and thereby reduces wear.

The above and other features of this invention will be fully understood from the following detailed description and the accompanying drawings, in which:

DETAILED DESCRIPTION OF THE INVENTION

Figure 1:
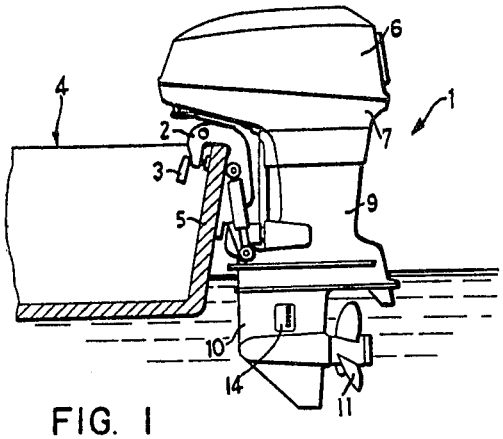
FIG. 1 is a side elevation showing an outboard motor.
Figure 2:
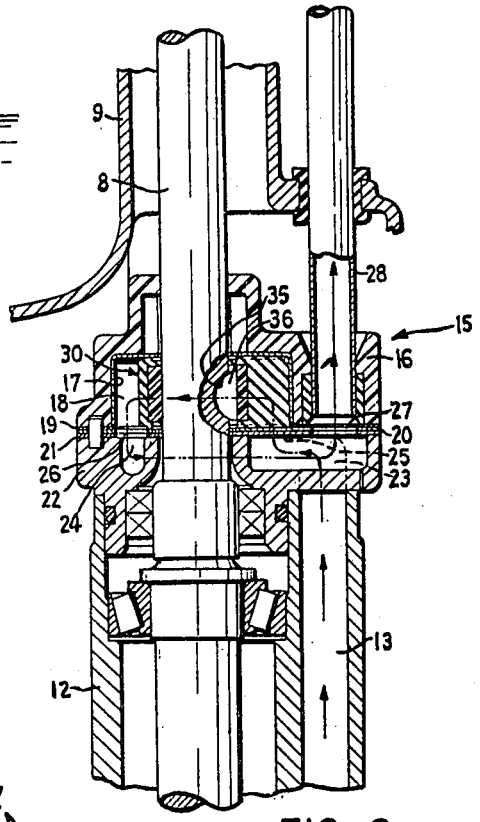
FIG. 2 is a sectional view showing a water pump according to the invention.

An outboard motor 1 is shown attached to the transom 5 of a boat 4 through a clamp 3 mounted on a bracket 2. The outboard motor 1 thus attached is equipped with a water-cooled two-cylinder engine (not shown) which is mounted in an engine cavity defined by a top cowling 6 and a bottom cowling 7. The engine drives a drive shaft 8 that passes through an upper case 9 and a lower case 10 to where it is connected to a propeller 11 mounted in the lower case 10. Lower case 10 is made integral with an inner wall 12, as shown in FIG. 2, so that drive shaft 8 passes through a space inside inner wall 12 that is itself within lower case 10. Inner case 12 in lower case 10 is further formed integrally with an inlet passage 13 which has communication, as shown in FIG. 1, with a water inlet 14 formed in the side of the lower case 10. At the upper end of lower case 10, there is located a water pump 15 which is mounted in upper case 9.

In water pump 15, a metal housing 17 is buried in a pump body 16 made of a synthetic resin or the like, thus constituting a pump chamber 18. To the lower sides of pump body 16 and housing 17, there is attached a bottom plate 20 through a gasket 19, thus constituting the lower side of the pump chamber 18. To bottom plate 20, moreover, there is attached through another gasket 21, a lower housing 22, which is connected to the upper end edge of inner wall 12 of lower case 10.

In lower housing 22, there are formed a suction passage 23 and a discharge passage 24, which are partitioned from each other. Suction passage 23 has communication with inlet passage 13. Suction passage 23 has another communication with pump chamber 18 through an inlet port 25 which is formed in gasket 21 and in bottom plate 20.

On the other hand, discharge passage 24 has communication with pump chamber 18 through a discharge port 26 formed in the bottom plate 20 and the gasket 21, and also with a discharge pipe 28 through a communication port 27 which is opened through gasket 21, bottom plate 20 and gasket 19. Discharge pipe 28 leads to the engine through upper case 9. In pump chamber 18, there is arranged drive shaft 8, which vertically extends in a slightly offset position and which carries an impeller 30.

Figure 3:
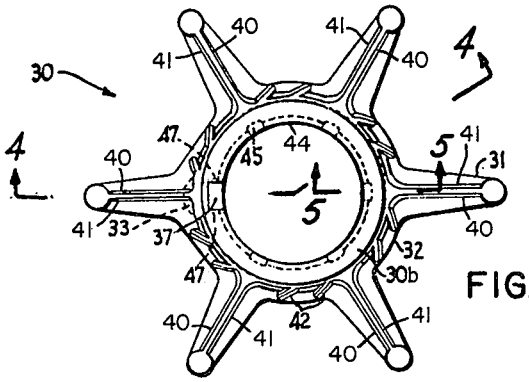
FIG. 3 is a bottom plan view showing an impeller.
Figure 4:
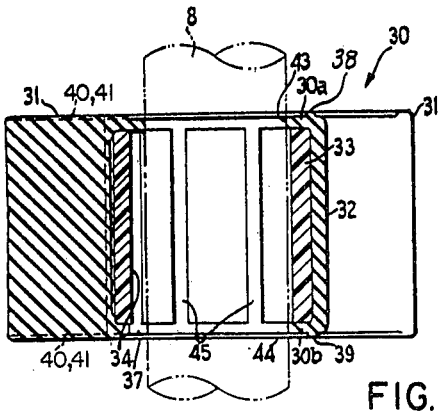
FIG. 4 is a section taken along line IV—IV in FIG. 3.
Figure 5:
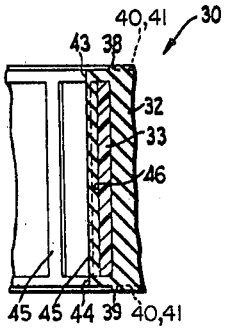
FIG. 5 is a section taken along V—V in FIG. 3.

Impeller 30 is shown in detail in FIG. 3. More specifically, is composed of a plurality of vanes 31 and a boss, which are made of an elastic material such as rubber. There is buried in the inner circumference of the boss 32 a bush 33 which is made of a material which has a greater rigidity than that of the vanes 31 and the boss 32, e.g., a synthetic resin known under the trade name of "Nylon 66" or a brass plate.

Bush 33 is formed with a keyway 34, which is arranged to face a keyway 35 formed in drive shaft 8. A woodruff key 36 is fitted between keyways 34 and 35 so that the bush 33, i.e., impeller 30, is fixed on drive shaft 8. Moreover, both axially facing ends 30*a* and 30*b* of boss 32 are made to cover the both ends of the bush 33. Lower end 30*b* is formed with a notch 37 that merges into keyway 34. The upper and lower faces at the ends are formed with annular lips 38 and 39, respectively, which are in sliding contact with the top and bottom of pump chamber 18, respectively.

According to the present embodiment, vanes 31 have both of their axial end edges formed with lips 40 and 41, and their inter-root portions formed with lips 42 so that lips 40, 41 and 42 are contained in the respective plane extending from annular lips 38 and 39. Ends 30*a* and 30*b* of boss 32 are respectively provided with seals 43 and 44 on their inner circumferences. Seals 43 and 44 extend radially inwardly from the inner circumference of bush 33 so that they are in abutment contact with the outer circumference of the drive shaft 8 with a proper interference. Seals 43 and 44 are peripheral "bands", and ribs 45 (see next paragraph) are longitudinal "strips". Seals 43, 44 and ribs 45 are unitary and continuous with one another, and with the remainder of boss 32. Seals 43 and 44 are inward extensions of ends 30 and 30*b*, respectively, and the outwardly facing surfaces of ribs 45 are contiguous to the inwardly-facing surface of bush 33.

On the inner circumference of boss 32, there are arranged a plurality of ribs 45 which are made of an elastic material and which extend in the axial direction while being circumferentially spaced from one another. Ribs 45 have their axial ends leading to seals 43 and 44. Their inner circumferences lie in the same plane as that of seals 43 and 44. Moreover, bush 33 has its inner circumference formed with anchor grooves 46 which are sized and positioned to receive the outer sides of the corresponding ribs 45 which ribs form part of outer boss 32. According to the present embodiment, moreover, axial ribs 47 are arranged at the both sides of keyway 34 of bush 33 integrally with boss 32.

Impeller 30, having the construction thus far described, is fixed to drive shaft 8 so that drive shaft 8 extends through bush 33 and key 36 fits between keyways 34 and 35. Under this condition, seals 43 and 44 and ribs 45 have their inner sides abutting against the outer side of the drive shaft 8 with the proper interference.

With the use of the water pump having the construction thus far described, impeller 30 is turned with drive shaft 8 so that a vacuum is established at the inlet side of pump chamber 18, thereby to suck water from the outside into pump chamber 18 through water inlet 14, inlet passage 13, suction passage 23 and inlet port 25. The water sucked into pump chamber 18 is gradually pressurized and discharged from discharge port 26 to be fed to the engine through discharge passage 24, communication port 27 and discharge pipe 28.

Now, in case the outside water contains foreign substances such as fine sand particles, the foreign substances naturally enter pump chamber 18. Since, however, boss 32 of impeller 30 is equipped with annular lips 38 and 39 at its upper and lower ends, the foreign substances are blocked by lips 38 and 39 so that their leakage creeping into the inside of boss 32 around the lips 38 and 39 is reduced. Since, moreover, seals 43 and 44 formed on the inner circumferences at both ends 30*a* and 30*b* of boss 32 are in abutment contact with the outer circumference of the drive shaft 8, impeller 30 can retain such a position that its center axis is aligned with that of the drive shaft 8, i.e., it is prevented from being inclined with respect to the drive shaft 8. As a result, even if impact or stress is exerted on impeller 30, the inclination of impeller 30 is so reduced that the rate at which lips 38 and 39 are apart from the inner side of the pump chamber 18 is reduced thereby to ensure the sliding contact between lips 38 and 39 and the inner side of pump chamber 18, and to ensure the elastic contact between the seals 43 and 44 and the drive shaft 8.

As a result, foreign substances in the pump chamber 18 can be prevented from creeping into the clearance between drive shaft 8 and bush 33. Still moreover, since ribs 45 are circumferentially spaced from one another, the foreign substances, if any, can be prevented from spreading all over the entire circumference, and the muddy water itself can be prevented from moving in that clearance while prohibiting entry of new muddy water. As a result, no wear takes place between drive shaft 8 and bush 33, and little muddy water steals into the clearance between keyways 34 and 35 so that wear of key 36 is reduced. This lengthens the life of the assembly. Moreover, the clearance between keyway 34 and key 36 is sealed up by ribs 47, which is mounted in the keyway 34, so that it can be free from muddy water, thus making it possible to prevent key 36 from being worn.

Still moreover, since ribs 45 are arranged in plurality in the inner circumference of the bush 33, it is easy to retain clearance for the sliding movement when the drive shaft 8 is inserted therethrough. In other words, if ribs 45 were formed continuously all over the inner circumference of bush 33, they would cause a high resistance to the insertion of drive shaft 8 with the resultant difficulty. If, however, ribs 45 are formed independently in the circumferential direction, as has been described above, they are liable to be elastically deformed in the circumferential direction thereby to establish a proper clearance when the drive shaft 8 is inserted, so that the drive shaft 8 can be easily inserted. As a result, the assembly can be accomplished promptly and easily.

Figure 6:
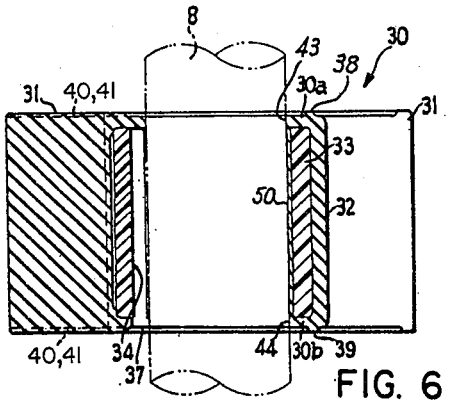
FIG. 6 is similar to FIG. 4, but shows another embodiment of the present invention.
Figure 7:
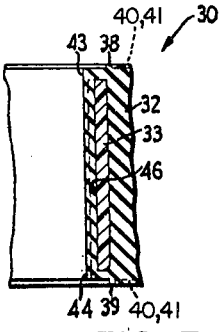
FIG. 7 is similar to FIG. 5 but shows the second embodiment of FIG. 6.
Figure 8:
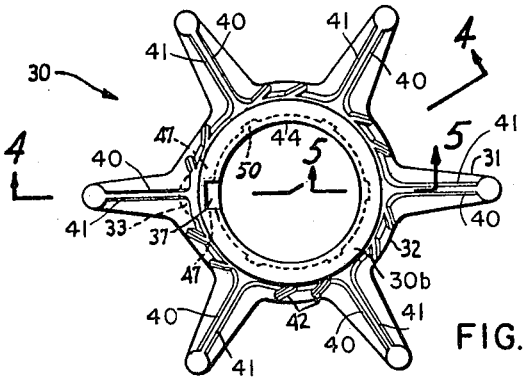
FIG. 8 is similar to FIG. 3 but shows the second embodiment.
Figure 9:
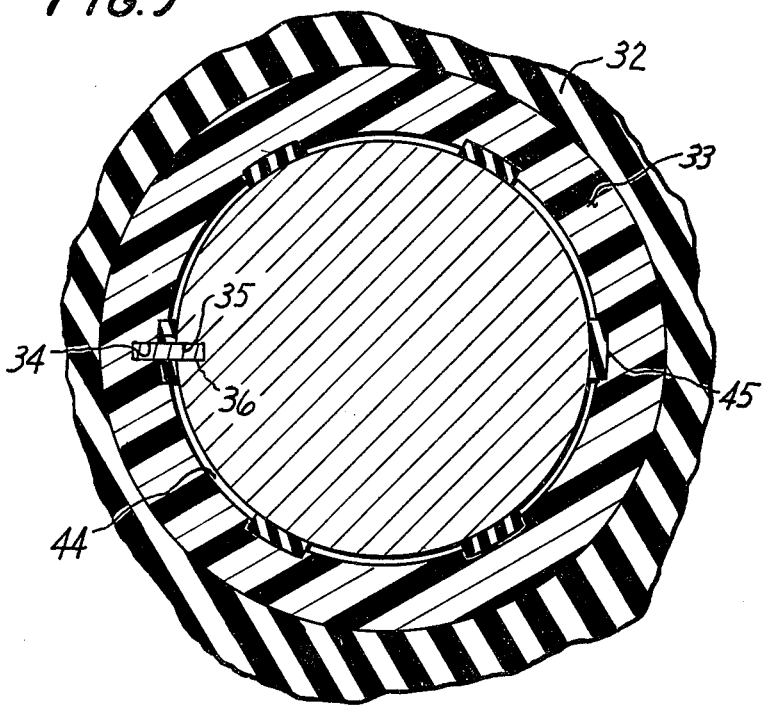
FIG. 9 is a fragmentary central lateral cross-section taken at line 9—9 in FIG. 4.

FIGS. 6 and 8 show a second embodiment of the present invention. This second embodiment is made the same as the first embodiment except that a connector 50 is provided in the whole circumference of the drive shaft 8, excepting the portion which is formed with the keyway 34.

Incidentally, although the foregoing description of the respective embodiments is directed to the situation in which the present invention is applied to the water pump of an outboard motor, the present invention should not be limited thereto but can also be applied to a pump for any liquid which pump can utilize an impeller made of an elastic material.

On the other hand, the present invention should not be limited to the construction of seals 43 and 44 which are provided on the inner sides of both ends 30*a* and 30*b* of boss 30, because these seals can be dispensed with if the annular lips can perform their intrinsic functions.

As has been described hereinbefore, according to the present invention there is provided a structure in which a bush is buried in the boss of an impeller that is made of the elastic material. The bush is keyed to the drive shaft, and the boss has its axially upper and lower ends equipped with annular lips held in sliding contact with the inner ends of the pump chamber. The structure is characterized in that connecting means for connecting the upper and lower ends of the annular lips is formed in the inner circumference of the bush. According to this structure, the impeller is prevented by the connector between the drive shaft and the bush from being inclined so that the annular lips can be prevented from leaving the ends of the pump chamber. As a result, the rate at which the foreign substances in muddy water can steal into the clearance between the drive shaft and the bush, is reduced, thereby to protect the drive shaft and the bush from being worn, and to eliminate the entry of foreign substances into the keyways. Thus, the key and the keyways can be less worn over a period of time. In case the plural ribs are provided in the circumferential direction, as in the first embodiment, they establish no high resistance to the insertion of the drive shaft into the bush with the resultant advantage that the drive shaft can be easily inserted to accomplish the assembly at a high speed.

Moreover, even if foreign substances steal into the clearance between the ribs, they can be prevented from distributing over the entire circumference, and the movements of the muddy water are regulated so that additional foreign substances do not enter.

This invention is not to be limited by the embodiments shown in the drawings and described in the description, which are given by way of example and not of limitation, but only in accordance with the scope of the appended claims.

I claim:

1. In a rotary type liquid pump having an axis, a pump chamber surrounding said axis, a pair of chamber faces lying parallel to one another and normal to said axis, a rotary shaft axially mounted in said pump chamber and having a cylindrical periphery in said pump chamber, with a keyway therein, a boss made of elastic material and bearing impeller blades, a tubular bush made of material more rigid than the material of the boss fitted into said boss, having a keyway opposite the keyway on said shaft, a key seated in said keyways and joining said shaft and bush, the improvement comprising said cylindrical periphery being smooth, a flexible annular seal on each end of said boss engaging the said periphery, and extending between said seals, and fitting between said bush and said shaft, a connector extending between and connecting with said seals, and making a fluid sealing abutting fit against said periphery.

2. Apparatus according to claim 1 in which said connector is tubular with a smooth uninterrupted inner cylindrical wall except where pierced to give access to said keyway.

3. Apparatus according to claim 2 in which said connector is elastically deformable.

4. Apparatus according to claim 1 in which said connector comprises a plurality of circumferentially spaced apart, axially extending ribs.

5. Apparatus according to claim 4 in which each of said ribs has a smooth wall to make said fluid sealing fit.

6. Apparatus according to claim 5 in which the circumferential areas between said ribs are recessed from contact with said periphery.

7. Apparatus according to claim 6 in which said ribs are elastically deformable.

* * * * *